United States Patent [19]

Gattu et al.

[11] Patent Number: 4,688,690

[45] Date of Patent: Aug. 25, 1987

[54] METHOD AND APPARATUS FOR EXTENDING FLY SECTION OF CRANE BOOM

[75] Inventors: Narahari Gattu, Coralville; Bryan K. Bailey, Cedar Rapids, both of Iowa

[73] Assignee: Harnischfeger Corporation, Brookfield, Wis.

[21] Appl. No.: 837,176

[22] Filed: Mar. 7, 1986

[51] Int. Cl.[4] ..... B66C 23/06

[52] U.S. Cl. ..... 212/268; 52/115

[58] Field of Search ..... 212/177, 187, 188, 264, 212/266-268; 52/115-118, 121

[56] References Cited

U.S. PATENT DOCUMENTS

| | | | |
|---|---|---|---|
| 3,738,075 | 6/1973 | Nansel | 52/115 |
| 3,795,321 | 3/1974 | Johnston | 212/268 |
| 4,327,533 | 5/1982 | Sterner | 212/268 |
| 4,350,255 | 9/1982 | Blase et al. | 212/268 |
| 4,433,515 | 2/1984 | Mentzer et al. | 52/115 |
| 4,434,902 | 3/1984 | Goode et al. | 212/268 |

*Primary Examiner*—Joseph F. Peters, Jr.
*Assistant Examiner*—Stephen P. Avila
*Attorney, Agent, or Firm*—James E. Nilles; Nicholas A. Kees

[57] ABSTRACT

Method and apparatus for extending a fly section of a telescopic crane boom which fly section does not have its own power unit to effect extension or retraction. The boom includes a base section, an inner powered section telescoping within the base section, an outer powered section telescoping within the inner section, and a non-self-powered fly section telescoping within the outer section. To extend the fly section, a load pin connecting the fly section to the outer section is released using a hydraulic cylinder mounted to the base section. The load pin is locked in the released position by a locking device. The outer section is then extended, taking the fly section with it. Upon full extension of the outer section, the inner end of the fly section is latched to the inner section or base section by latch pins actuated by a hydraulic cylinder. The outer section is then retracted, exposing the fly section and unlocking the load pin from its released position. The load pin then simply slides along the bottom of the fly section until, upon full retraction, the load pin snaps into a hole at the inner end of the fly section to prevent relative motion of the fly section and the outer section. The fly section is then unlatched from the inner section or base section. At this point the outer section and inner section may be independently operated, with the fly section in fully extended position. The fly section is then retracted by basically reversing the procedure. A circuit is also provided so as to prevent both the load pin and the latch pins from being disengaged simultaneously unless the fly section is fully retracted within the outer section.

15 Claims, 20 Drawing Figures

METHOD AND APPARATUS FOR EXTENDING FLY SECTION OF CRANE BOOM

BACKGROUND OF THE INVENTION

This invention relates to multisection telescopic booms such as used on mobile cranes or the like, and in particular to means and a method for extending and retracting the outermost fly section of the crane which does not have its own power source without the need for a second human operator and without the need for the first operator to leave the cab or lower the boom.

Various types of multisection, telescopic crane booms are known and which need to be extended to great lengths, to handle very heavy loads, and to be relatively light and compact to facilitate their mobility. Accordingly, it is customary to design such cranes so that, in operation, the fly section is extended and retracted by means other than power means located in the fly section, in order to reduce the weight and expense of the fly section. For example, Johnston, U.S. Pat. No. 3,795,321, discloses a crane boom of the general type under consideration, means and a method for extending a fly section without its own power extension means, and describes a method of extending or retracting a fly section by connecting the movable portion of a hydraulic ram to the fly section. To make this connection, the crane operator must align several access and pinning holes in the various boom sections, and because these holes can only be visually aligned and the crane operator cannot see the holes when controlling the boom sections from the cab, it is required that a second worker be positioned alongside the boom sections to signal the crane operator when the holes are in alignment.

The device of Johnston also requires heavy pins to connect the fly section to the second section when the former is retracted or extended relative to the latter, which pins must be inserted manually. This can be difficult even for a strong individual, as the access and pinning holes on larger cranes are often several yards above the ground even when the boom is in its lowermost position. This may necessitate the operator's climbing in a ladder or otherwise being elevated to a level such that the pin can be inserted. Furthermore, the size of the pin connecting the fly and second section or load pin is limited to the size that an operator can lift in place. In the boom described by the Johnston patent, where the load pin is inserted through the sides of the fly section and the second section and is in contact with both sections whether the fly section is extended or retracted from the second section, the load pin must transfer axial and bending loads. When the boom section is extended or retracted, the load pin must transfer all axial loads from the boom point to the rest of the boom. When the boom section is extended, the load pin must also transfer all bending loads from the boom point to the rest of the boom. Thus, in the extended or retracted position, the lift capacity of the boom is limited by the shear strength of the pin, which in turn is limited by the size pin the operator can lift in place.

The stop pins, which are used in the Johnston patent to maintain the fly section's axial position relative to the base section while other movable sections are being extended or retracted, must also be inserted manually in Johnston, and are thereby limited in size because of the factors listed hereinabove which limit the size of the load pins. In order to fully extend the fly section of Johnston's patented device, the stop pins must be inserted therein. When the fly section in Johnston has been fully extended, the load pin must be inserted to maintain the fly in this extended position while the telescopable sections are moved axially. If the stop pins are inadvertently not removed from the fly section after the load pin has connected the extended fly section and the second section, and the second section is then telescoped into the third and base section, breakage of the stop pin may result. Such breakage is more likely when the stop pins are of relatively light construction, and when access to and removal of the stop pins is relatively difficult.

Another example of an apparatus for extending a non-self-powered fly section is shown in Mentzer, U.S. Pat. No. 4,490,951, which discloses a latch mechanism for remotely operating and locking a manual fly section of a multisection crane boom. However, the latch pin cylinder, hydraulic valve, hoses and electrical wires are located inside the boom where cost of service and access may be higher. Moreover, the fly section disclosed in that patent must be manually locked for road travel, and manually unlocked before remotely extending the boom. This manual operation defeats the purpose of having a remotely operable fly section. In addition, only one latch pin or stop pin is provided so that if this pin is inadvertently not removed from the fly section after the load pin has connected the extended fly section and the second section, and the second section is then retracted, uneven stresses, bending of the power cylinder and even damage to the crane may result.

This invention relates to improvements over the inventions described above and to solutions to the problems raised thereby.

SUMMARY OF THE INVENTION

A multisection telescopic boom of a mobile crane is provided with means for extending a telescopic section thereof without power to that section and without the necessity of anyone besides the operator in the cab to insert and remove the pin means associated with the boom for locking the fly section in certain positions. The pin means includes a load pin which passes through the outermost powered section and engages the fly section to hold it in the retracted position, such as for road travel. An actuator mechanism is supplied to be operated remotely by the machine operator, for retracting the load pin and keeping it retracted. When the outermost powered section is fully extended together with the fly section, latch pins are remotely actuated to engage the fly section and lock it to the next lower boom section. The outermost powered section is then retracted, in effect extending the fly section relative to it. On completion of this retraction, the load pin again automatically engages the fly section to lock it in its extended position with respect to the outermost powered section, and the latch pins are remotely disengaged. A control circuit is provided so as to prevent the load pin and the latch pins from being in their disengaged positions simultaneously, unless the fly section is retracted in the outer section.

The invention provides a boom having a fly section which does not have its own power extension/retraction unit, but which can nevertheless be fully extended and retracted, including locking into place in either position, without any other aid to the cab operator.

Another aspect of the invention is to provide a boom as described above wherein the fly section can be extended and retracted, including locking into place in either position, with the boom raised to any angle and even set up through a narrow opening at a job site.

A more specific feature of the invention is to provide a boom wherein the non-self-powered fly section has a load pin which engages the fly section to the next section due to spring loading automatically in both the extended and retracted positions and which is disengaged by a hydraulic cylinder or other power source under direct control of the crane operator in the cab.

Another feature of the invention is to provide a boom wherein the non-self-powered fly section is latched to a powered section of the boom for extension, and then unlatched, by hydraulic cylinders or other power means all under direct control of the crane operator in the cab.

Yet another feature of the invention is to provide a boom wherein the load pin and the latch pins are prevented from being simultaneously disengaged unless the fly section is retracted within the outer powered section.

The invention also includes a method for extending and retracting the fly section. To extend the fly section, load pin means connecting the fly section to the outer section is released from the outer load pin engaging means using power means mounted to the base section. The load pin means is locked in the released position by a locking means. The outer section is then extended, taking the fly section with it. Upon full extension of the outer section, the inner end of the fly section is latched to the inner section or base section by latch pin means. The outer section is then retracted, exposing the fly section and unlocking the load pin means from its released position. The load pin means then simply slides along the bottom of the fly section until, upon full retraction, it engages an inner load pin engaging means to prevent relative motion of the fly section and the outer section. The fly section is then unlatched from the inner section or base section. At this point the outer section and inner section may be independently operated, with the fly section in fully extended position. The fly section is retracted basically by reversing the procedure.

Other aspects and advantages of the invention will become apparent hereinafter.

DESCRIPTION OF THE PREFERRED EMBODIMENTS

Figure 1:
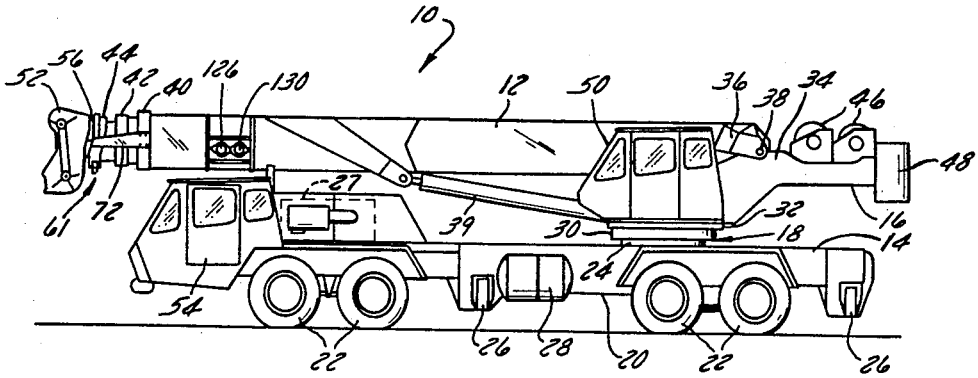
FIG. 1 is a side elevational view of a mobile crane having a boom with a fly section which is not self-powered, but which is extended by the operator from the cab, constructed according to the invention.
Figure 2:
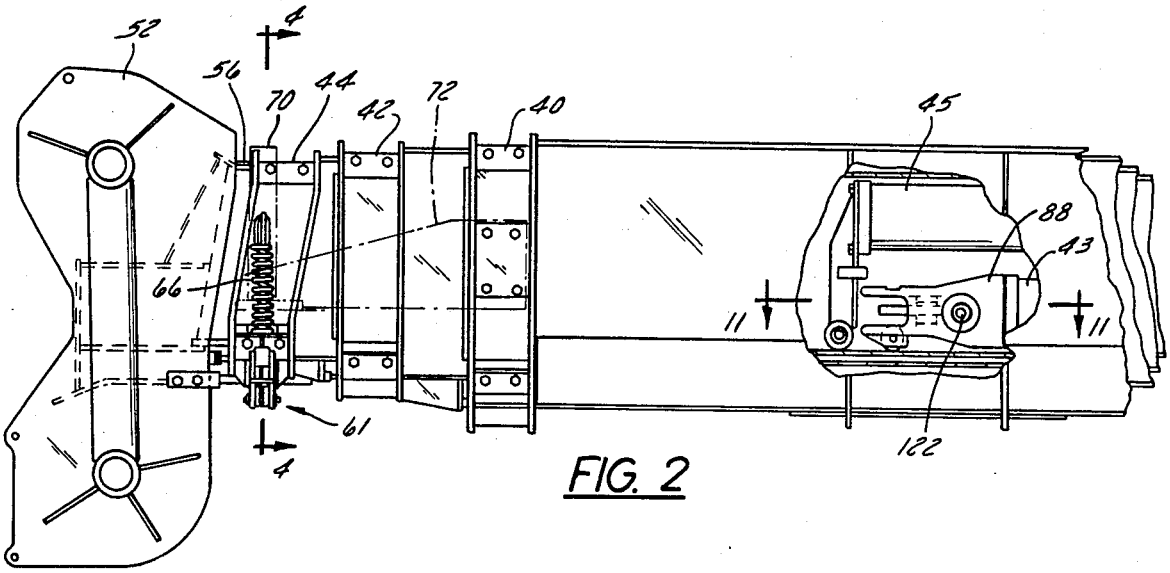
FIG. 2 is an enlarged view of a portion of the crane boom shown in FIG. 1, partially cut away to show the latch pin assembly.

Referring now to FIG. 1, there is shown a self-propelled crane generally at 10, carrying a telescopic crane boom 12. Crane 10 also includes a lower section 14 on which an upper section 16 is mounted by means of a slew ring assembly 18 for rotation in either direction to an unlimited degree about a vertical axis during crane operation. Lower section 14 comprises a chassis 20 on which are mounted a plurality of wheel assemblies such as 22, a fixed ring 24 of the aforesaid slew ring assembly 18, four extendible outriggers such as 26 for deployment during crane operation, a source of power such as an internal combustion engine 27 for providing operating power to the crane and for providing motive power for the wheel assemblies 22, and a hydraulic fluid reservoir 28 for supplying operating fluid to certain vehicle and crane components. Upper section 16 comprises a rotatable ring 30 of the aforesaid slew ring assembly 18 and a support frame 32 which is rigidly secured to ring 30. A boom support assembly 34 is rigidly mounted on support frame 32 and telescopic boom 12 is mounted by means of a pivot assembly 36, including a pivot pin 38, on support frame 32 for pivotal movement such as by boom hoist cylinder 39, between raised and lowered positions about a horizontal axis during crane operation. In the description which follows, the word "inner" when referring to a particular end of a boom section or a particular section itself, is used to mean closer to boom support assembly 34, while "outer" is used to mean further from boom support assembly 34. Telescopic boom 12 includes a base boom section 40, an inner boom section 42 telescopable within the base boom section, an outer boom section 44 telescopable within the inner boom section, and a manual fly section 56, that is, a fly section without its own power means for extension or retraction, telescopable within outer boom section 44. Supporting frame 32 also affords support for two cable winches such as 46, a counterweight 48 and an operator's cab 50. Boom 12 terminates in a boom head 52. Also located on chassis 20 is a carrier cab 54.

Figure 1B:
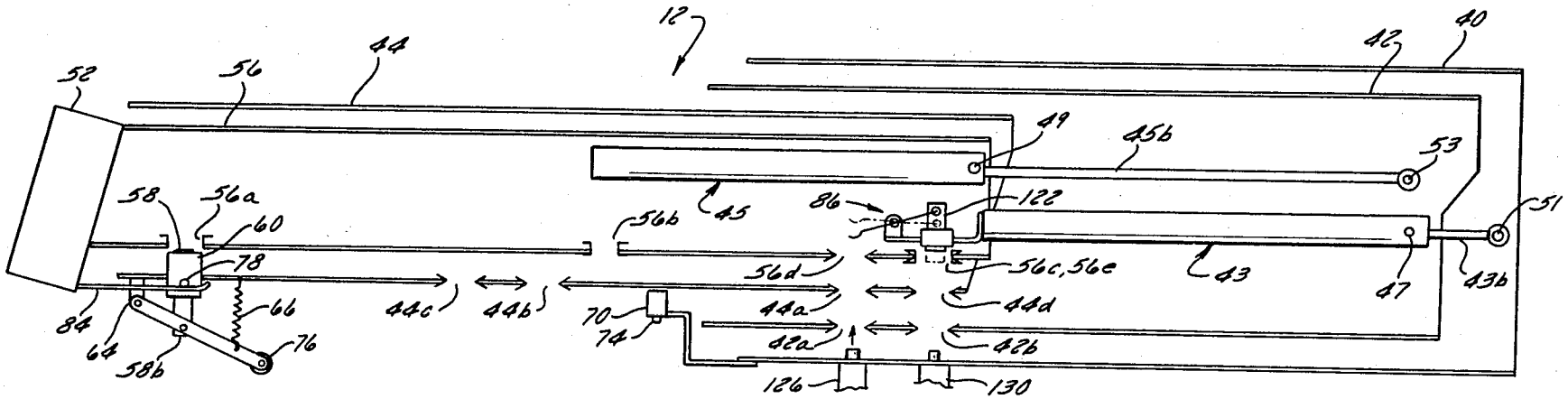
FIGS. 1A, 1B and 1C are schematic views of a crane boom constructed according to the invention in various stages of extension.
Figure 1A:
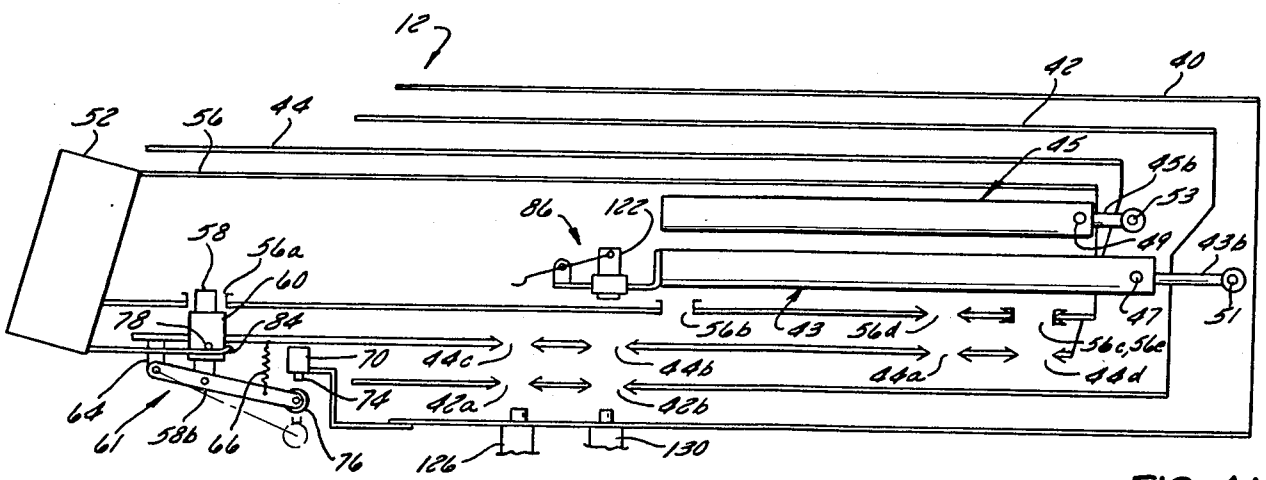
Figure 1C:
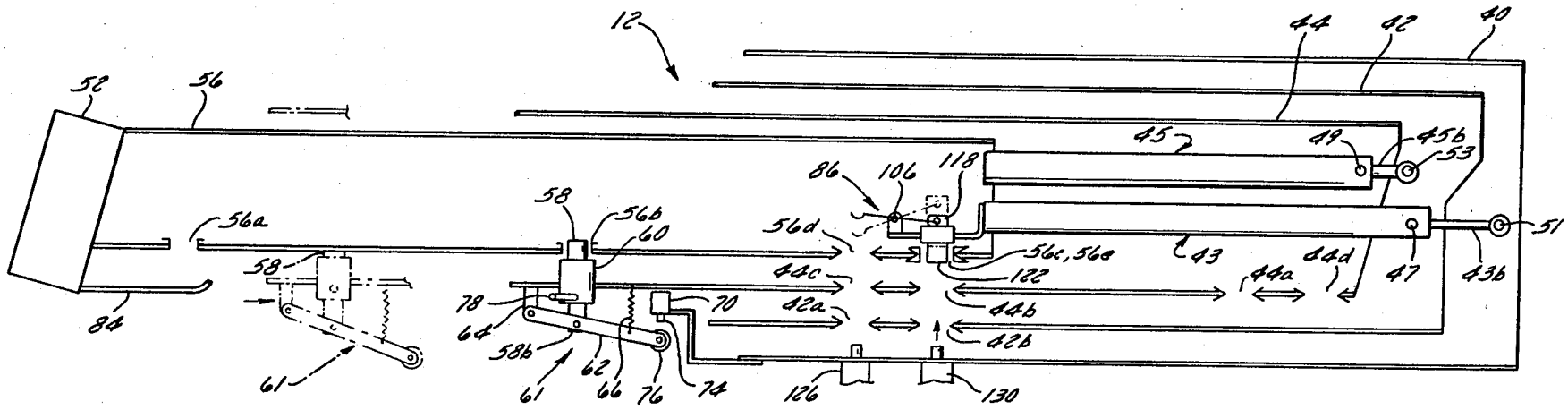

The operation of extending the fly section 56 of the boom 12 can be seen schematically by comparing FIGS. 1A, 1B and 1C. The preferred details of the various components referred to will be set forth after the schematic explanation. In FIG. 1A, the boom 12 is shown in the completely retracted position. Power means for extending and retracting inner boom section 42 and outer boom section 44 are shown in FIG. 1A to be hydraulic cylinders 43 and 45 respectively. These cylinders 43 and 45 are elongated in shape and have extendable and retractable outer portions 43*a* and 45*a* connected at their inner ends by any suitable means such as pins 47 and 49 to inner boom section 42 and outer boom section 44, respectively. Similarly anchor portions 43*b* and 45*b* of these cylinders may be connected by pins 51 and 53 to base boom section 40 and inner boom section 42, respectively.

When the boom 12 is in the travel position as shown in FIGS. 1 and 1A, a load pin 58 (FIG. 1A) slidably mounted via a collar 60 to the outer end of outer section 44 and engages a hole 56*a* at the outer end of fly section 56 to prevent relative movement between outer section 44 and fly section 56. Load pin 58 is held in engagement by an engagement-disengagement apparatus 61 which includes a lever 62 pivotably attached to the outer end of outer section 44 and biased upward by biasing means 66. The first step in the fly section extension operation is to disengage the load pin 58 from fly section 56. This is accomplished by a hydraulic cylinder 70 or other power source connected at the outer end of base section 40, extending and pivoting lever 62 downward to the position shown in phantom in FIG. 1A. This in turn disengages load pin 58 from load pin hole 56*a* in fly section 56. Cylinder 70 is in position to disengage load pin 58 only when the cylinder is aligned over the distal end of lever 62. Notice that this occurs only when outer section 44 is fully retracted with respect to base section 40. When cylinder 70 is extended, the load pin is disengaged and held so by a plunger 78 which is biased outward within load pin 58. Next, outer boom section 44 is fully extended by use of its power cylinder 45 as shown in FIG. 1B, carrying with it the fly section 56 with load pin 58 locked in disengaged position by plunger 78. The next step in the process is that a latching means 86, attached to the outer end of inner section power cylinder 43, is caused to engage fly section 56 at a hole 56*c* as shown in phantom in FIG. 1B. This latching can be accomplished by any suitable means such as a pivoting toggle assembly 110 actuated by a power source such as a hydraulic cylinder 126 attached to the outside of base section 40 accessing toggle assembly 110 through access holes 44*a*, 42*a* and 56*d* in the respective section. Hence, fly section 56 is affixed to inner boom section power cylinder 43 which is already fully retracted. Because the inner end of cylinder 43 is connected to base section 40, and because the latching is only accomplished when cylinder 43 is fully retracted, it would be equivalent for latching means 86 to affix fly section 56 to base section 40. For this reason when the term "first section" is used hereinafter, it will be taken as referring to the base section 40 and the inner section 42. The next step is to retract outer boom section 44 to the position shown in FIG. 1C. Since fly section 56 is now attached to inner boom section power cylinder 43, it remains extended with the retraction of the outer boom section 44. This, in turn, causes relative movement between fly section 56 and outer boom section 44. On the occurrence of this relative movement load pin resetting means 84 pushes in plunger 78 and resets load pin 58, allowing it to move upward so that it rides against the bottom of fly section 56, as shown in phantom in FIG. 1C, until full retraction of outer boom section 44 is achieved, at which time load pin 58 snaps into engagement with the inner locking hole 56*b* in the bottom of fly section 56. Finally, the latching means 86 is disengaged from fly section 56 by cylinder 130, which is mounted on the outside of base section 40 and contacts the latching means 86 through access holes 42*b* and 44*b* in the respective boom sections. At this point the fly section 56 is locked in extended position and the two self-powered sections 42 and 44 may be freely extended or retracted as needed.

The fly section 56 may be retracted by reversing the procedure. In particular, inner section 42 and outer section 44 are fully retracted. Cylinder 126 actuates toggle assembly 110 via access holes 42*a* and 44*c* to engage latching means 86 to fly section 56. At the same time, cylinder 70 disengages load pin 58 from inner load pin hole 56*b*. Plunger 78 locks load pin 58 in the disengaged position. Outer section 44 is then extended, in effect telescoping fly section 56 into it. Just before it reaches full extension, resetting means 84 resets load pin 58, which snaps upward against the bottom of fly section 56. Then, when full extension of outer section 44 is reached, load pin 58 engages outer load pin hole 56*a*. Cylinder 130 then disengages latching means 86 from fly section 56 through access holes 44*d* and 42*b* of the respective boom sections. Then when outer section 44 is retracted, fly section 56 is locked to it by load pin 58.

As can be seen, all of the above steps may be accomplished by the operator from the cab by control of hydraulic cylinders 70, 126 and 130 connected to the base section 40, even with the boom 12 positioned through a narrow opening and at any overhead position. Since the cylinders are connected to the base section, no hose loops or hose reels are required. Moreover, access holes allow visual inspection of latch pins for improved safety and, if necessary, manual operation of the latch pins. And the size of the various pins required can be determined based solely upon the masses and stresses expected to be encountered in operation of the crane boom, without regard to whether or not an operator is physically able to manipulate and handle a pin of the particular size required.

Figure 3:
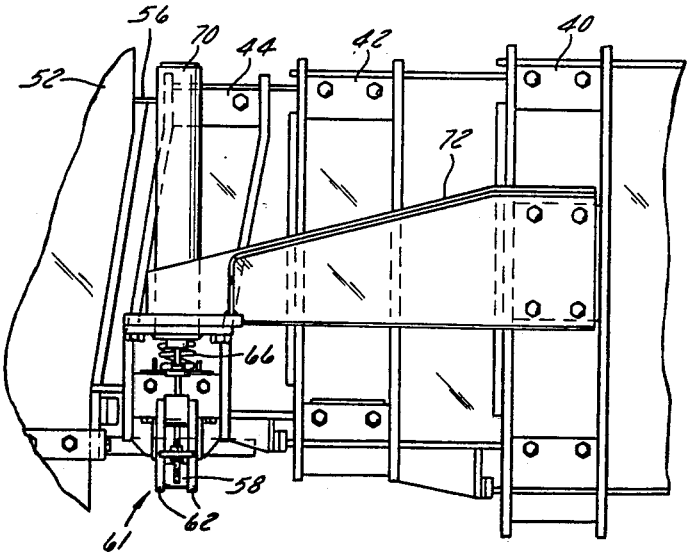
FIG. 3 is a further enlarged view of a smaller portion of the crane boom shown in FIG. 2 showing the load pin release mechanism and support therefor.
Figure 4:
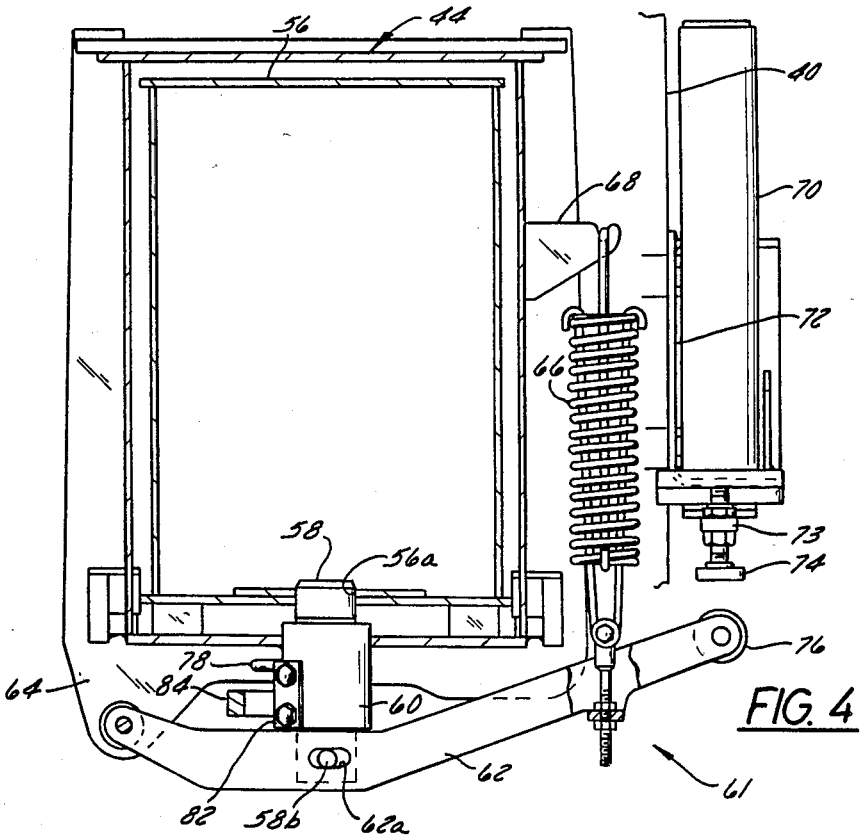
FIG. 4 is a cross sectional view, showing the load pin release mechanism, taken along line 4—4 of FIG. 2.
Figure 5:
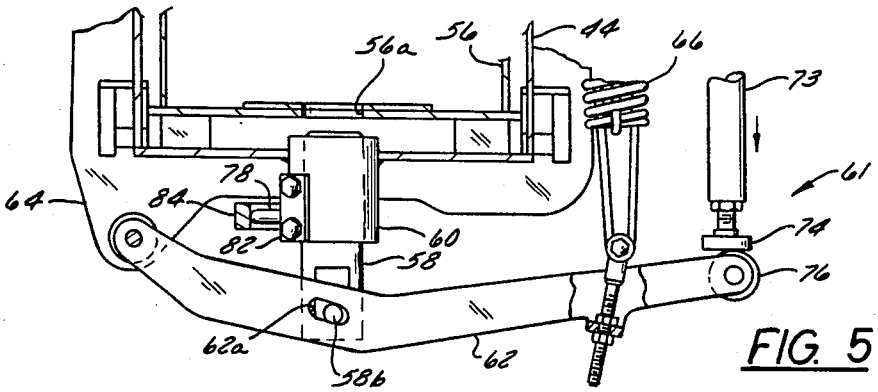
FIG. 5 is a view of the apparatus shown in FIG. 4 showing the load pin in the release position.
Figure 6:
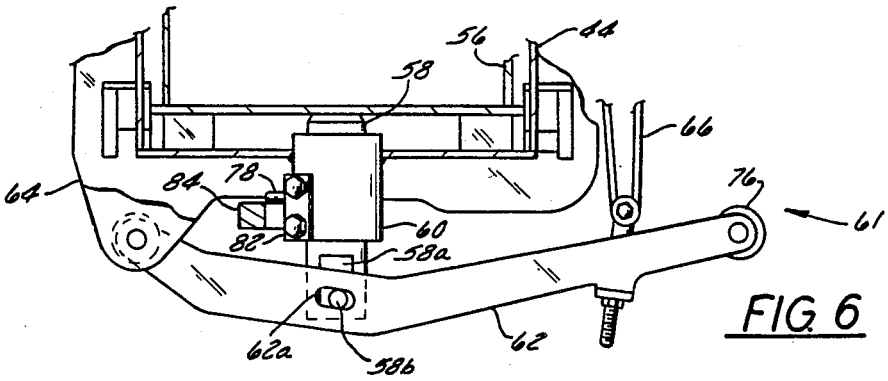
FIG. 6 is a view of the apparatus showing the load pin bearing on the bottom of the fly section of the crane boom.

FIGS. 2 through 5 show the preferred arrangement of the load pin 58 and the apparatus 61 for releasing and engaging the load pin. The purpose of the load pin 58, shown best in FIG. 4, is to prevent fly section 56 from moving with respect to outer boom section 44. As shown in FIG. 4, the load pin 58 passes through a collar 60 affixed to the outer boom section 44 and engages a hole 56*a* in the bottom of fly section 56. The load pin 58 is held in hole 56*a* by a spring biased lever 62 having one end pivotably attached to the frame 64 of outer boom section 44 and the other end connected via a spring strut 66 to a tab 68 which is, in turn, connected to the side of outer boom section 44. Spring strut 66 is a telescoping strut resiliently loaded and biased to the contracted position. As shown best in FIGS. 2 and 3, lever 62 is preferably a double link which straddles the flattened lower end 58*a* of load pin 58. Lever 62 engages load pin 58 by means of slots 62*a* into which are fitted a pin 58*b* projecting from both of the flats of end 58*a*. (Slots 62*a* are necessary to be slots because of the pivoting action of lever 62 combined with the sliding action of load pin 58 within its collar 60.) In order to disengage load pin 58 from fly section 56, a means to actuate assembly 61 is required. In the embodiment shown, a hydraulic cylinder 70 is connected to boom base section 40 by a bracket 72 (FIG. 3). Bracket 72 locates cylinder 70 so as to be over the same end of lever 62 as is connected to strut 66 when outer section 44 is in its fully retracted position. Hydraulic cylinder 70 preferably is a double acting cylinder and a small hydraulic pressure is maintained on the rod side when not in use to hold the cylinder in the retracted position. This can also be a single acting cylinder with a spring return (not shown). A piston 73 of cylinder 70 terminates in a push pad 74, which is aligned to contact a roller 76 at the end of lever 62. Thus when the cylinder 70 is activated push pad 74 forces roller 76 and, in turn, lever 62 downward. This action draws load pin 58 downward and out of hole 56*a*, such that fly section 56 is free to slide or otherwise move with respect to outer boom section 44. This unlocked position is shown in FIG. 5. Were it not for plunger 78 described in more detail below, load pin 58 would then slide right back into the hole 56*a* in the bottom of fly section 56, since it is biased upward by strut 66. Instead, plunger 78 locks load pin 58 out of hole 56*a* until the fly section 56 is slid far enough out of outer section 44 so that the pin 58 and hole 56*a* are no longer aligned. Pin 58 is then allowed to move upward and bear on the bottom of fly section 56, as shown in FIG. 6, until inner load pin hole 56*b* is encountered, at which point the pin will snap upward into the hole and assume the position shown in FIG. 4, with the fly section in the extended position.

Figure 8A:
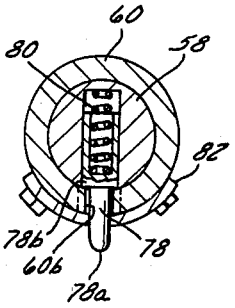
FIGS. 8A and 8B are fragmentary cross sectional views of the load pin mechanism showing the spring loaded plunger in two of its different positions, taken along line 8—8 of FIG. 7.
Figure 8B:
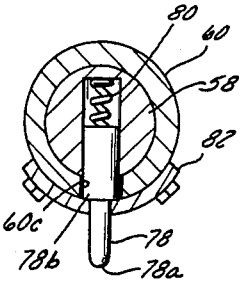
Figure 7:
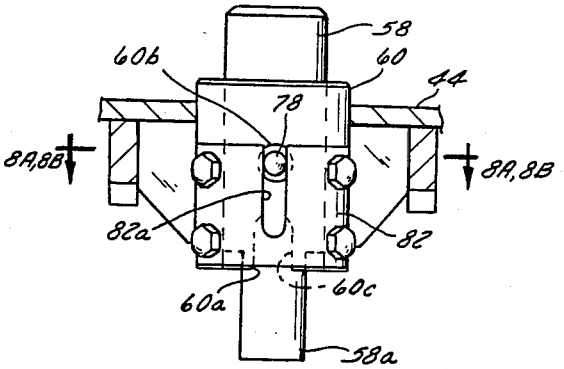
FIG. 7 is a fragmentary side view, partially in section, of the load pin constructed according to the invention.

The plunger 78 referred to above is shown in more detail in FIGS. 7, 8A, 8B, 9 and 10. As shown in FIGS. 7, 8A and 8B, a plunger 78 is spring loaded transversely within load pin 58, biased outward by an internal spring 80, and protrudes partially out of the side of pin 58. Plunger 78 preferably has two distinct diameters. The tip 78*a* of plunger 78 is of relatively smaller diameter while the base 78*b* is of larger diameter. Referring to FIG. 7, collar 60 has a slot 60*a* having a narrower portion 60*b* and a wider portion 60*c*. When load pin 58 is in the engaged position as shown in FIG. 4, plunger 78 is in the narrower portion 60*b* of slot 60*a* (FIG. 7), and only the tip 78*a* protrudes outside the load pin 58 itself (FIG. 8A). When the load pin 58 is in the lowered position as shown in FIG. 5, plunger 78 has been moved to align with the wider portion 60*c* of slot 60*a*, and base 78*b* of plunger 78 is allowed to reach outside collar 60, as shown in FIG. 8B. Plunger 78 is retained within load pin 58 by any suitable means such as a retainer plate 82 bolted or otherwise removably affixed over slot 60*a* and having its own slot 82*a* which runs parallel to slot 60*a* but has only a single width matching that of narrower portion 60*b* of slot 60*a*. Thus retainer plate 82 allows the required vertical motion of plunger 78 and prevents loss of the plunger. In this manner the load pin 58 is allowed to move downward by the action of lever 62 (FIGS. 4 and 5). Once it has done so, plunger 78 snaps into the large part 60*c* of slot 60*a*, and prevents the load pin 58 from moving back up again due to the pressure of strut 66. The only way to release load pin 58 and allow it to move back up is to push the plunger 78 back into the load pin 58 so the body 78*b* is not in the larger portion 60*c* of slot 60*a*.

Figure 9:
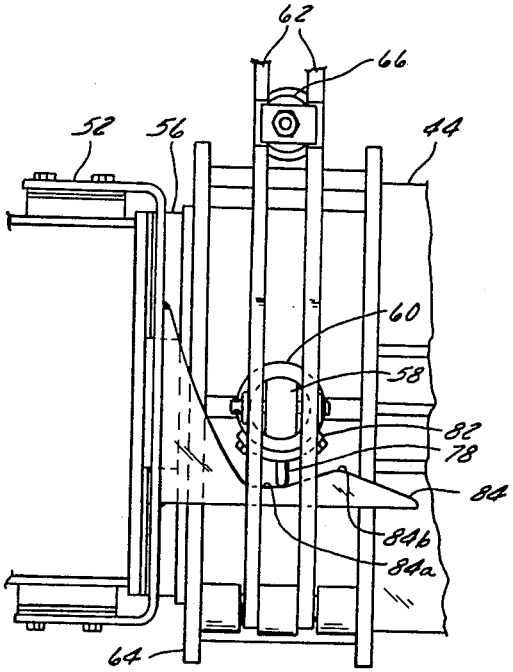
FIGS. 9 and 10 are bottom views of the apparatus shown in FIG. 3 and show the reset cam acting on the spring loaded plunger to reset the load pin.
Figure 10:
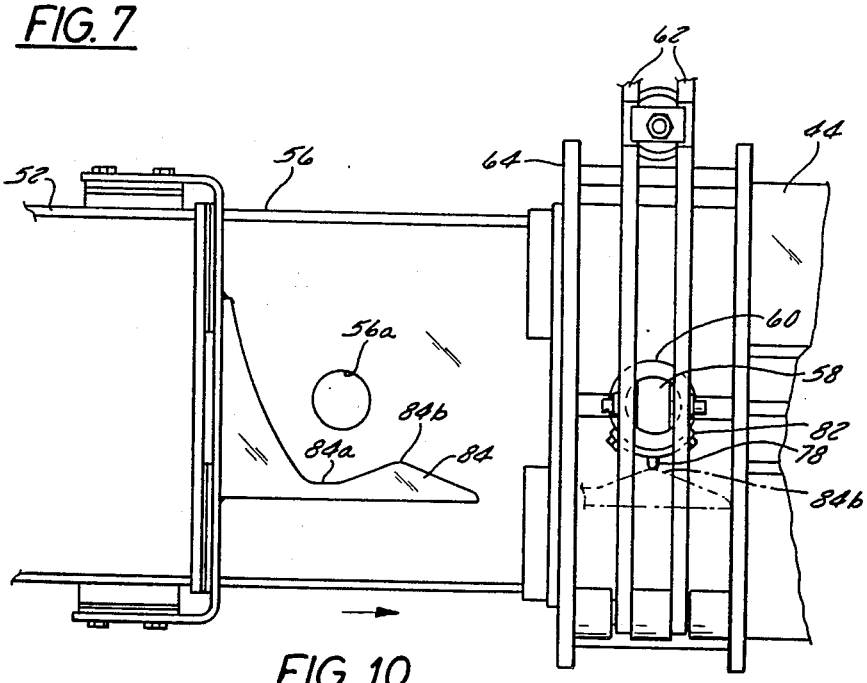

FIGS. 9 and 10 show a reset means 84 provided for the purpose of pushing in the plunger 78 when needed. This reset means 84 is in effect a cam secured to the underside of fly section 56 by any suitable means and may be adjustable so as to actuate the plunger to the proper extent at the proper time. Thus when load pin 58 is in place in hole 56*a* as shown in FIG. 4, or when it is first dropped out of the hole 56*a* as shown in FIG. 5, plunger 78 is aligned with a low area 84*a* of the cam of reset means 84, as shown in FIG. 9, and the plunger is allowed to pop out as described above with reference to FIGS. 7 and 8B. Plunger 78 has thus locked load pin 58 in the disengaged position as shown in FIG. 5. When outer boom section 44 then moves with respect to fly section 56, plunger 78 must pass over a high area 84*b* of the cam of reset means 84, as shown in phantom in FIG. 10. This, of course, pushes plunger 78 in and allows load pin 58 back up, but by this time load pin 58 is no longer aligned with hole 56*a* in the fly section 56, and so the pin 58 rides on the bottom of fly section 56 (FIG. 6) until it encounters inner load pin hole 56*b*, which then engages load pin 58. Outer load pin hole 56*a* is located near boom head 52, and allowing load pin 58 to snap into that hole locks fly section 56 into its retracted or travel position. Inner load pin hole 56*b* is located at the inner end of fly section 56 and cooperates with load pin 58 to lock the fly section in the extended position.

Figure 11:
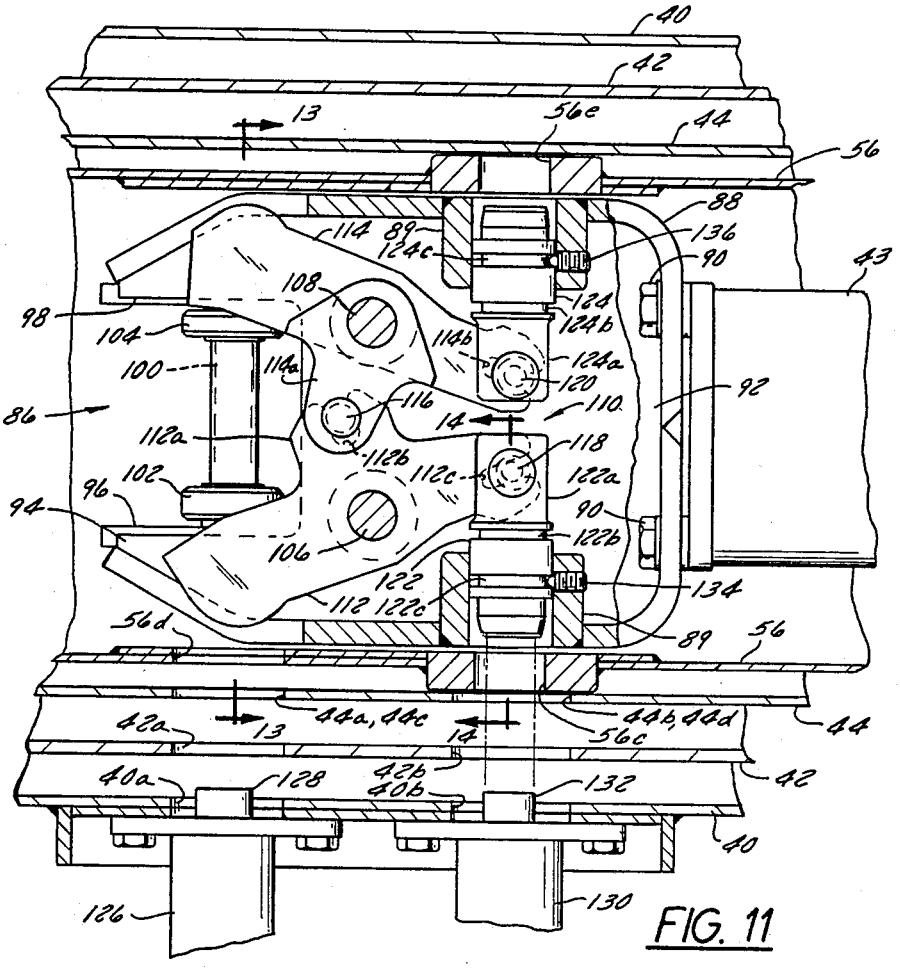
FIG. 11 is a sectional view of the latch pin assembly showing the latch pins in the disengaged position, taken along line 11—11 of FIG. 2.
Figure 14:
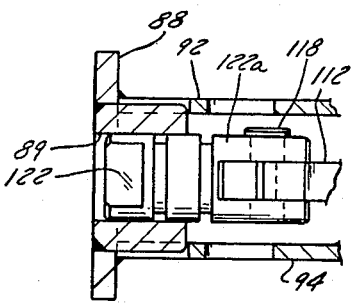
FIG. 14 is a cross sectional view of FIG. 12, taken along line 14—14, showing a side view of a latch pin.
Figure 13:
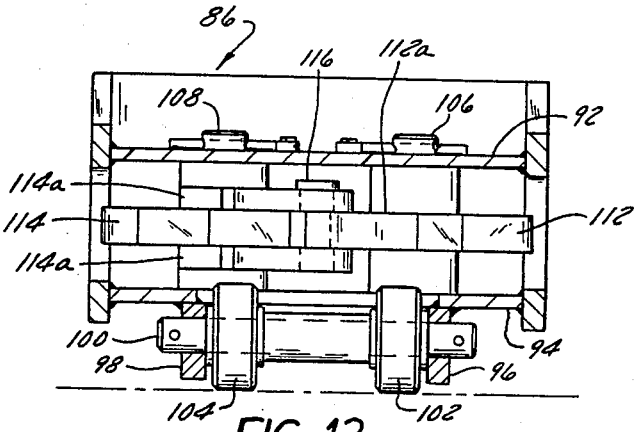
FIG. 13 is a cross sectional view of FIG. 12, taken along line 13—13, showing an end view of the latch pin carriage.
Figure 12:
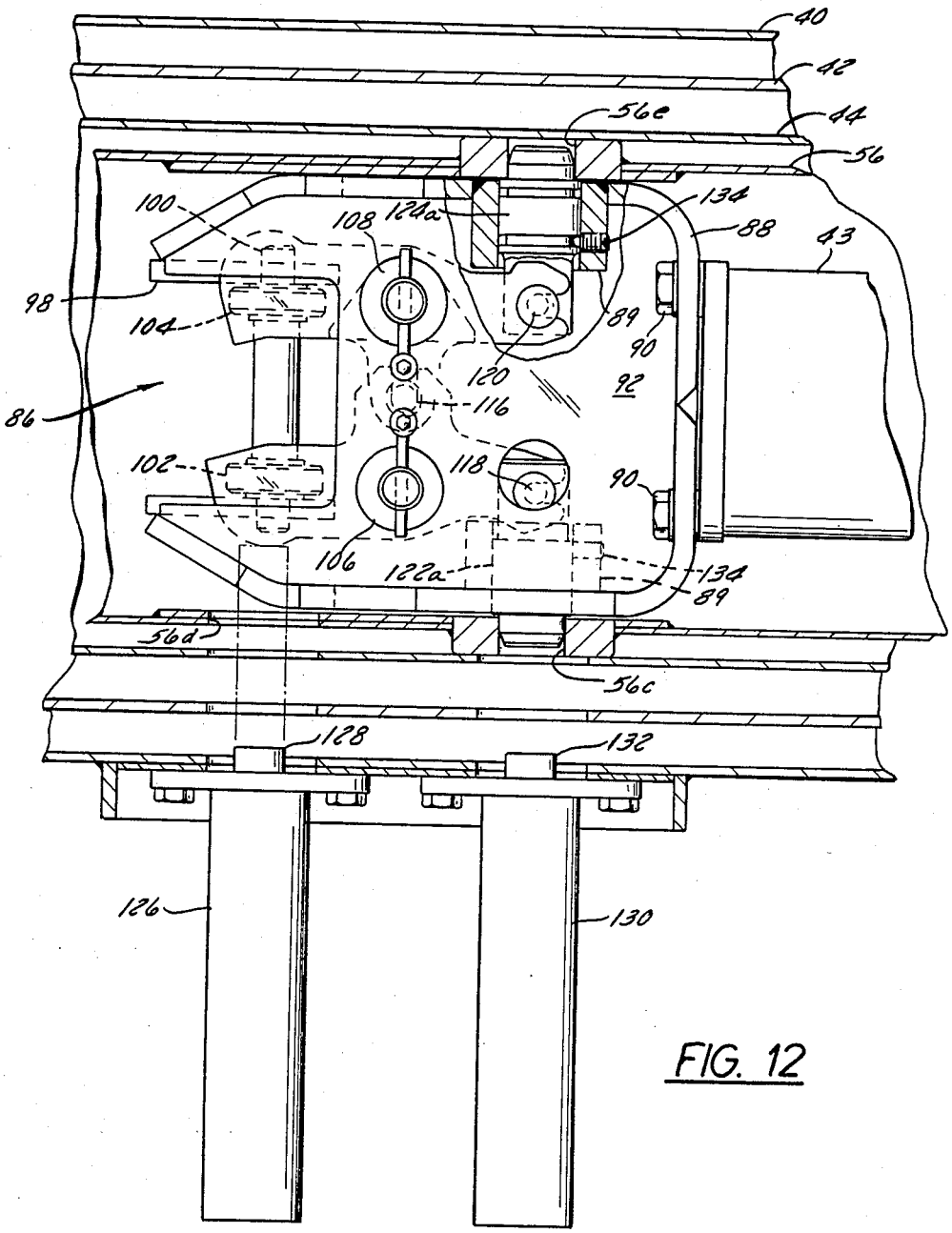
FIG. 12 is a view similar to FIG. 11, showing the latch pins in the engaged position.

As described earlier, after the outer section 44 and fly section 56 are fully extended together, the fly section is preferably latched by latch pin means 86 to the inner boom cylinder 43 or base section 40 temporarily so that the outer boom section 44 can be retracted from fly section 56. The latch pin means 86 and toggle mechanism 110 are shown in FIGS. 11, 12, 13 and 14. FIG. 11 shows the latch pin means 86 in its normal, disengaged position. The latch pin means 86 includes a U-shaped frame 88 which is securely but removably connected to the outer end of hydraulic cylinder 43 by suitable means such as bolts 90. As can be seen in the sectional view in FIG. 13, the latch pin means 86 also includes an upper horizontal plate 92 and a lower horizontal plate 94 affixed within the curve of the U-shape of frame 88. Two tabs 96 and 98 are connected to the underside of lower plate 94 and horizontally spaced apart. These tabs hold an axle 100 on which are journaled two wheels 102 and 104 for facilitating the back and forth movement of the latch pin means 86 with respect to fly section 56 on which it rests. Referring again to FIGS. 11 and 12, a pair of pivot pins 106 and 108 are vertically connected between plates 92 and 94 and horizontally spaced apart. Journaled to these pins is the toggle assembly 110 which includes two toggle plates 112 and 114. Toggle plate 112 pivots on pin 106 while toggle plate 114 pivots on pin 108. The two toggle plates are joined together by link portions 112*a* and 114*a* integrally formed near the lengthwise center of the respective plates and which join in a pin and slot arrangement. As shown best in FIG. 13, link 114*a* is preferably a double link while link 112*a* is a single link. Further, link 114*a* holds a pin 116 which engages a slot 112*b* in link 112*a* (FIG. 11). Thus whenever plate 112 is caused to rotate on pin 106 in one direction, for example clockwise, plate 114 is thereby caused to rotate on pin 108 in the opposite direction, in the example given counterclockwise. Referring again to FIG. 11, each of the plates 112 and 114 terminates at one end in a slot 112*c* and 114*b* which mates with a pin 118 and 120. These pins are held in the clevis portions 122*a* and 124*a* of a pair of latch pins 122 and 124 which, in turn, are laterally slidably mounted in pin guide tubes 89 welded or otherwise attached to the sides of frame 88. At least two of these latch pins are provided, arranged symmetrically about the longitudinal center line of the boom so as to provide symmetry of support in case the boom were inadvertently attempted to be moved with both the latch pins and load pin engaged, so as to prevent damage to the boom. A sectional view showing a side view of latch pin 122 and associated parts is given at FIG. 14. When fly section 56 is fully extended with respect to base section 40 and inner section 42 is fully retracted, latch pins 122 and 124 align with a pair of openings 56*c* and 56*e*, respectively, in the sides of fly section 56. As referred to above, FIG. 11 shows latch pins 122 and 124 in the disengaged position. As shown in FIG. 12, these latch pins are toggled into engaged position, that is, a position where they are in fly section openings 56*c* and 56*e* as well as pin guide tubes 89 at a time when the openings are aligned, by a hydraulic cylinder 126 attached to the outside of base boom section 40. As there shown, the piston 128 of cylinder 126 is aligned with access holes 40*a*, 42*a*, 44*a* and 56*d* in the respective boom sections when the sections are retracted. When piston 128 is extended as there shown in phantom, it contacts cam end 112*d* of toggle plate 112. Piston 128 then exerts a push force on cam end 112*d* of toggle plate 112, causing it to rotate clockwise about pin 106, thereby causing toggle plate 114 to rotate counterclockwise about its pin 108, in turn forcing latch pins 122 and 124 out of assembly 86 and into holes 56*c* and 56*e* in fly section 56. Another hydraulic cylinder 130 is provided to disengage the latch pins 122 and 124. As shown in FIG. 11, cylinder 130 is also attached to the outside of base boom section 40 and aligned with latch pin 122 and access holes 40*b*, 42*b*, 44*b* and 56*c* in the respective boom sections when the sections are retracted. Then, when the piston 132 of cylinder 130 extended as shown in phantom in FIG. 11, the piston contacts the near side latch pin 122 directly and pushes it out of opening 56*c* in fly section 56 which, via toggle plates 112 and 114, also draws opposite side latch pin 124 out of the opening 56*d* on that side of fly section 56. Cylinders 126 and 130 are preferably double acting cylinders. A small pressure is maintained on the rod side when not in use to hold the cylinders in the retracted position. This feature prevents the piston from sliding out under vibratory conditions and avoids damage to the boom sections and the piston during the boom extension and retraction operations. These cylinders may also be single acting with a spring return (not shown). A spring biased detent means is provided to facilitate positive engagement and disengagement of latch pins 122 and 124 to fly section 56. This detent means includes a pair of transverse grooves provided in each latch pin. Thus latch pin 122 has an engagement groove 122*b* near its clevis portion 122*a* and a disengagement groove 122*c* nearer the opposite end. Similarly, latch pin 124 has an engagement groove 124*b* near its clevis portion 124*a* and a disengagement groove 124*c* nearer the opposite end. Each latch pin is provided with a locking ball 134 and 136, respectively, biased in the sides of pin guide tubes 89 against each latch pin 122 and 124, and located so as to snap into one or the other of the grooves, and thereby provide positive positions for engagement and disengagement of the latch pins 122 and 124.

Figure 16:
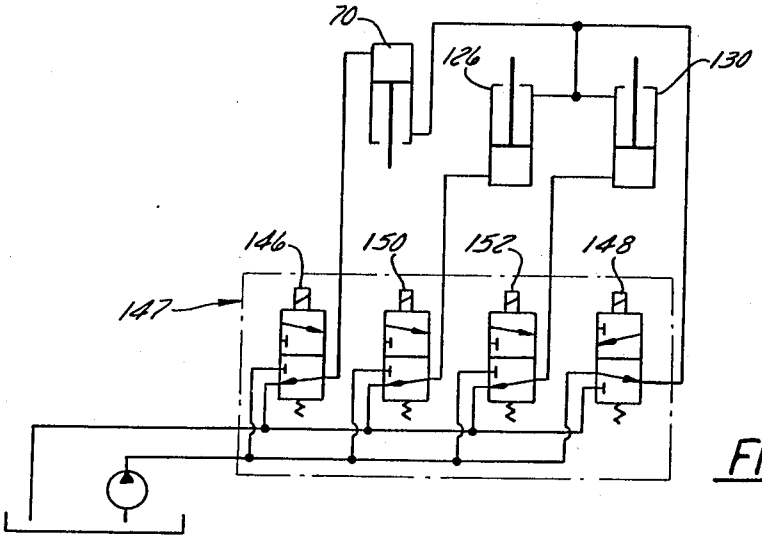
FIG. 16 is a schematic diagram of a portion of the hydraulic circuit which works with the electrical circuit shown in FIG. 15 to ensure that the load pin and the latch pins are generally not all disengaged at the same time.
Figure 15:
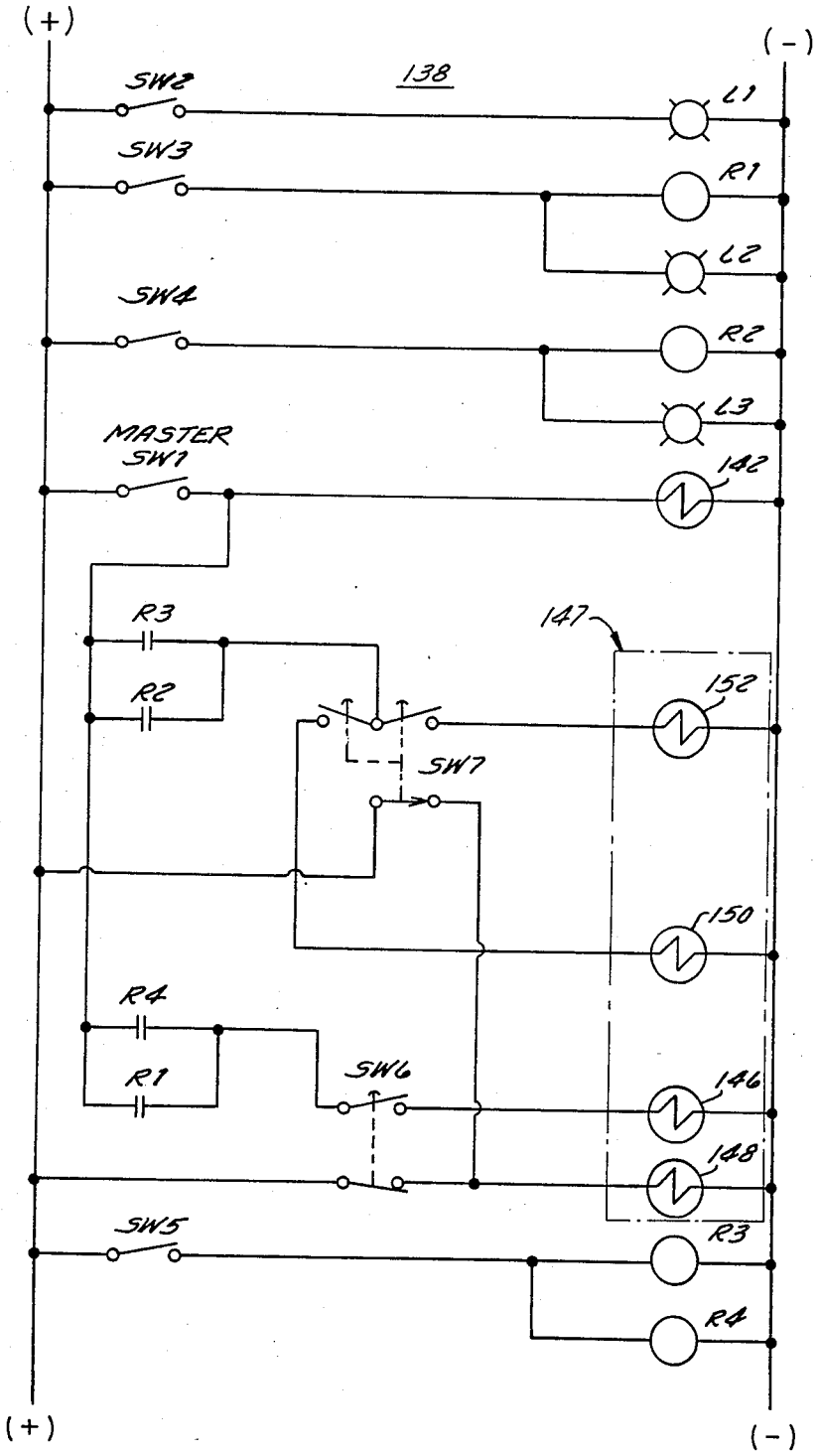
FIG. 15 is a schematic diagram of the electrical circuit provided to ensure that the load pin and latch pins are generally not all disengaged at the same time.

As shown in FIG. 15, the crane 10 includes an electrical circuit 138 for controlling the various power means and hydraulic cylinders hereinbefore described. In particular, this circuit 138 also includes means to prevent the load pin 58 from being disengaged during the time the latch pins 122 and 124 are disengaged, and vice versa, and means for disabling the power cylinder 43 for inner section 42 when the load pin hydraulic cylinder 70 or the latch pin hydraulic cylinders 126 and 130 are in use. The circuit 138 includes a master switch SW1, closure of which disables the cylinder 43 by means of solenoid 142. This is done to ensure that cylinder 43 is not energized during the fly extension operation, since to do so could result in damage to the pins or the cylinders. Means are provided to indicate whether the load pin 56 and latch pins 122 and 124 are engaged, and to show whether the fly section 56 is retracted within the outer section 44. Further, means are provided for preventing cylinder 70 from moving load pin 58 to its released position if the latch pins 122 and 124 are disengaged and the fly section 56 is not retracted, and for preventing cylinder 130 from moving latch pins 122 and 124 to their released positions if load pin 58 is disengaged and fly section 56 is not retracted. In the preferred embodiment, a pair of switches SW2 and SW3 are provided to show the status of the latch pins 122 and 124. When the latch pins are disengaged as shown in FIG. 11, switch SW2 is closed and an indicator lamp L1, connected in series therewith, is lit. When the latch pins move to their engaged positions, as shown in FIG. 12, switch SW2 is opened and switch SW3 is closed, in turn lighting lamp L2 and energizing a relay R1. Thus when the latch pins are disengaged lamp L1 is lit while, when they are engaged, lamp L2 is lit. Switches SW2 and SW3 may be proximity switches or any other suitable switches activated by the position of latching pins 122 and 124. Another switch SW4 is located on boom 12 so as to be closed when load pin 58 is in its engaged position. An indicator lamp L3, in series therewith, is lit when switch SW4 is closed and acts as an indicator showing that the load pin is engaged. In addition, when switch SW4 is closed, a relay R2 is energized. A safety override switch SW5 is provided, positioned on boom 12 so as to be closed whenever the fly section 56 is retracted as shown schematically in FIG. 1A, or whenever outer section 44 and fly section 56 are extended. This switch SW5 controls two relays R3 and R4, so that both are energized when switch SW5 is closed. As can be seen in FIG. 15, the contacts of relays R1 and R4 are connected in parallel, as are the contacts of relays R2 and R3. Hence, closure of switch SW5 has the effect of overriding relays R1 and R2, and allowing an operator to disengage the load pin 58 and the latch pins 122 and 124 all at the same time. This is not undesirable since it is only allowed when the fly section 56 is retracted within the second section 44, so that no hazard is presented thereby. Assuming switch SW5 is open, however, the operation of the circuit 138 is as follows, referring to both FIGS. 15 and 16. When latch pins 122 and 124 are engaged, switch SW3 is closed and relay R1 is energized. This allows load pin switch SW6, when pressed by the operator, to energize a valve 146 of automatic pinning valve assembly 147 and, in turn, disengage the load pin 58 via cylinder 70. Release of switch SW6 closes valve 146 and opens valve 148 of assembly 147, supplying the small but constant amount of retracting pressure on cylinders 70, 126 and 130 as referred to earlier (FIG. 16). Then, when load pin 58 is engaged, switch SW4 closes and energizes relay R2. This allows latch pin switch SW7, when pressed on the left side by the operator, to energize valve 150 of assembly 147 and, in turn, engage latch pins 122 and 124 via cylinder 126. Or the operator can press the right side of switch SW7, which energizes valve 152 of assembly 147 to disengage latch pins 122 and 124. As with switch SW6, release of switch SW7 energizes valve 148 (shown best in FIG. 16) to provide the small amount of back pressure required to retract the pistons of cylinder 70, 126 and 130.

Hence circuit 138 provides a means for controlling the various power cylinders or power means and ensuring that the load pin and both latch pins are prevented from being disengaged at the same time, since to allow them all to be disengaged could result in uncontrolled movement of the fly section 56 with respect to the outer section 44.

While the apparatus hereinbefore described is effectively adapted to fulfill its intended objectives, it is to be understood that the invention is not to be limited to the particular preferred embodiments of method and apparatus for extending the fly section of a crane boom herein set forth. Rather, the invention is to be taken as including various reasonable equivalents without departing from the scope of the appended claims.

We claim:

1. In a crane:

a telescopic crane boom including a first section, an outer section and a fly section;

means to effect extension and retraction of asid outer section relative to said first section; and apparatus for extending and retracting said fly section in response to operation of said apparatus comprising:

load pin means for releasably connecting said fly section to said outer section in at last two positions, including a retracted positon and an extended position;

means for locking said load pin means in either of two positions, including an attached position wherein relative movement between said fly section and said outer section is prevented and a released position wherein such relative movement is allowed;

release means for moving said load pin means to said released position, thereby allowing relative movement between said fly section and said outer section;

latch pin means to releasably latch said fly section to said first section by a plurality of latch pin power means connected to said first section;

resetting means for resetting said load pin means from said released position to said attached position; and a release power means remotely controlled and attached to said first section;

said load pin means including a lever pivotably connected to said outer section, and a load pin connected to said lever, which load pin passes through a collar connected to said outer section and into engagement with a hole in said fly section when in said attached position, and which load pin means is caused to move from said attached position to said released position by said release power means.

2. A crane as recited in claim 1 further comprising biasing means for biasing said load pin means toward said attached position, and wherein said resetting means acts to release said locking means and allow said biasing means to move said load pin means towards said attached position.

3. A crane as recited in claim 2 wherein said locking means includes a plunger biased outward within said load pin which moves into an opening in the collar when said load pin means is moved to said released position to prevent said load pin means from returning to said attached position, and wherein said resetting means includes means for pushing said plunger out of said opening in said collar and allowing said load pin means to return to said attached position.

4. A crane as recited in claim 1 wherein said latch pin means includes a plurality of latch pins arranged approximately symmetrically about a longitudinal center line of said boom.

5. A crane as recited in claim 4 wherein said latch pin means further includes a toggle assembly which, when one of said plurality of latch pins is caused to move by said first latch pin power means, causes all of said latch pins to move to latch said fly section to said first section and when one of said plurality of latch pins is caused to move by said second latch pin power means, causes all of said latch pins to move to unlatch said fly section from said first section.

6. A crane as recited in claim 3 or 5 further comprising means for ensuring that said latch pin means and said load pin means are not both in their released positions at the same time unless said fly section is in its fully retracted position.

7. A crane as recited in claim 6 wherein said ensuring means includes:

means for sensing the positions of said load pin means, said latch pin means and said fly section; and means for preventing said load pin means from releasing if said latch pin means are in their released position and preventing said latch pin means from releasing if said load pin means are in their released position, unless said fly section is in its fully retracted position.

8. A crane as recited in claim 8 wherein said sensing means includes a plurality of switches, at least one of said switches closing when said latch pin means are in their engaged position, at least one of said switches closing when said load pin means are in their engaged position, and at least one of said switches closing when said fly section is in its retracted position; and wherein said preventing means include relays controlled by said switches for preventing both said latch pin means and said load pin means from being released at the same time unless the fly section is in its fully retracted position.

9. A crane boom comprising:

a first section;

an outer section telescopable within said first section and powered by power means connected between said first section and said outer section;

a fly section telescopable within said outer section;

each section including inner and outer ends;

inner and outer load pin engaging means located near the inner and outer ends respectively of said fly section;

latch pin engaging means mounted on said fly section near its inner end;

a load pin mounted on said outer section near its outer end and releasably engageable with either the inner or outer load pin engaging means on said fly section to releasably secure together said fly section and said outer section when said fly section is either extended or retracted, respectively, relative to said outer section;

a plurality of latch pins and operating means therefor mounted on said first section and releasably engageable with said latch pin engaging means;

disengaging means mounted on said outer section and said first section for disengaging said load pin from an engaged position;

locking means for locking said load pin in a disengaged position; and unlocking means mounted on said fly section for unlocking said load pin from its disengaged position just after the beginning of relative motion between said fly section and said outer section;

said disengaging means including:

a. a power means mounted to the outer end of said first section, b. a lever pivotably connected to the outer end of said outer section, said load pin being connected to said lever, and c. a collar connected to the outer end of said outer section, said load pin passing through said collar and into engagement with said load pin engaging means of said fly section, and said power means and said lever being aligned for actuation and disengagement of said load pin only when said outer boom section is fully retracted.

10. A crane boom as recited in claim 9 further comprising biasing means for biasing said load pin toward said engaged position.

11. A crane boom as recited in clasim 10 said locking means includes a plunger biased outward within said load pin which moves into an opening in said collar when said load pin is moved to said disengaged position to prevent said load pin from returning to said engaged position, and wherein said unlocking means includes means for pushing said plunger out of said opening in said collar.

12. A crane boom as recited in claim 9 wherein said operating means for said latch pins includes a toggle assembly which, when one of said latch pins is caused to engage said latch pin engaging means, causes all latch pins to so engage and, when one of said latch pins is caused to disengage from said latch pin engaging means, causes all latch pins to so disengage.

13. A crane as recited in claim 11 or 12 further comprising means for ensuring that said plurality of latch pins and said load pin are not all in their disengaged positions at the same time unless said fly section is in its fully retracted position.

14. A crane as recited in claim 13 wherein said ensuring means includes:

means for sensing the positions of said load pin, said plurality of latch pins and said fly section; and means for preventing said load pin from disengaging if aaid latch pins are in their disengaged position and preventing said latch pins from disengaging if said load pin is in its disengaged position, unless said fly section is in its fully retracted position.

15. A crane as recited in claim 14 wherein said sensing means includes a plurality of switches, at least one of said switches closing when said latch pins are in their engaged position, at least one of said switches closing when said load pin is in its engaged position, and at least one of said switches closing when said fly section is in its retracted position; and wherein said preventing means include relays controlled by said switches for preventing both said latch pins and said load pin from being disengaged at the same time unless the fly section is in its fully retracted position.

* * * * *